US009988806B2

(12) United States Patent
Segall

(10) Patent No.: US 9,988,806 B2
(45) **Date of Patent: *Jun. 5, 2018**

(54) RELOCATABLE HABITAT UNIT

(71) Applicant: Stuart Charles Segall, San Diego, CA (US)

(72) Inventor: Stuart Charles Segall, San Diego, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 14/881,440

(22) Filed: Oct. 13, 2015

(65) Prior Publication Data

US 2016/0090730 A1 Mar. 31, 2016

Related U.S. Application Data

(63) Continuation of application No. 14/217,216, filed on Mar. 17, 2014, now Pat. No. 9,157,249.
(Continued)

(51) Int. Cl.

| | |
|---|---|
| ***E04B 1/343*** | (2006.01) |
| ***E04B 1/00*** | (2006.01) |
| ***E04H 1/12*** | (2006.01) |
| ***E04B 1/02*** | (2006.01) |
| ***E04B 1/61*** | (2006.01) |
| ***E04C 2/30*** | (2006.01) |
| *E04C 2/00* | (2006.01) |

(52) U.S. Cl.
CPC ..... *E04B 1/34321* (2013.01); *E04B 1/02* (2013.01); *E04B 1/343* (2013.01); *E04B 1/34384* (2013.01); *E04B 1/61* (2013.01); *E04C 2/30* (2013.01); *E04H 1/1205* (2013.01); *E04B 2001/34389* (2013.01); *E04C 2002/001* (2013.01)

(58) Field of Classification Search
CPC ..... E04B 1/00; E04B 1/343; E04B 1/34321; E04B 1/34326; E04B 1/34384; E04B 2001/34389
See application file for complete search history.

(56) References Cited

U.S. PATENT DOCUMENTS

| | | | |
|---|---|---|---|
| 2,581,816 | A | 1/1852 | Schlueter |
| 42,994 | A | 5/1864 | Sellers |

(Continued)

FOREIGN PATENT DOCUMENTS

| | | |
|---|---|---|
| FR | 445075 A | 10/1967 |
| JP | 2000013082 | 1/2000 |

(Continued)

*Primary Examiner* — Phi D A
(74) *Attorney, Agent, or Firm* — Gary L. Eastman, Esq.; Eastman & McCartney LLP

(57) ABSTRACT

A field-deployable construction set for the assembly of a Relocatable Habitat Unit (RHU), used for simulating real world environments without costly construction expenses. The various panels, supports, and accessories used to construct an RHU provide the user with innumerable options for floor plans and building design, further providing significant options for reconfiguration of floor, ceiling, and wall panels without having to disassemble the structure. The exterior composition of the expanded polymer foam is customizable to provide a realistic environment for high quality training in a versatile system that is deployable by truck or aircraft and can be assembled with only a single tool.

18 Claims, 13 Drawing Sheets

Related U.S. Application Data

(60) Provisional application No. 61/800,838, filed on Mar. 15, 2013.

(56) References Cited

U.S. PATENT DOCUMENTS 182,141 A 9/1876 Wilson
419,920 A 1/1890 Campbell
797,768 A 8/1905 Fisher
1,149,488 A 8/1915 Arndt
1,276,932 A 8/1918 King
1,651,941 A 12/1927 Ashkenas
2,019,692 A 11/1935 Mueller
2,168,725 A 8/1939 Whelan
2,177,699 A * 10/1939 Fisher ..... E04B 1/24 174/505
2,647,287 A 8/1953 Jones
2,793,401 A 5/1957 Paschke
2,900,678 A 8/1959 Curtis
2,952,799 A 9/1960 Wortman et al.
3,135,542 A 6/1964 Wilkinson
3,236,014 A 2/1966 Edgar
3,280,522 A 10/1966 Card et al.
3,281,169 A 10/1966 Houvener
3,298,145 A 1/1967 Minervini
3,310,926 A * 3/1967 Brandreth ..... E04C 2/384 52/281
3,353,314 A 11/1967 Melcher
3,372,519 A 3/1968 Russell
3,391,512 A 7/1968 Lopina
3,392,497 A 7/1968 Cushman
3,421,459 A 1/1969 Sherwood
3,461,633 A 8/1969 Ziegelman et al.
3,468,977 A 9/1969 Hutchinson
3,471,356 A 10/1969 Kolb et al.
3,566,561 A 3/1971 Tozer
3,611,667 A 10/1971 Maxwell, Sr.
3,622,430 A 11/1971 Jurisich
3,645,573 A 2/1972 Strang
3,665,791 A 5/1972 Carr
3,716,954 A 2/1973 Kelbish
3,729,889 A 5/1973 Baruzzini
3,758,998 A 9/1973 Levin et al.
3,771,273 A 11/1973 Brodie
3,818,661 A 6/1974 Pragg
3,832,811 A 9/1974 Briel
3,913,292 A 10/1975 Braekkan
3,927,498 A * 12/1975 Benedetti ..... E04B 1/24 52/11
4,058,909 A 11/1977 Polen
4,102,097 A 7/1978 Zalotay
4,158,338 A 6/1979 Dippold et al.
4,160,610 A 7/1979 Austen-Brown et al.
4,258,511 A 3/1981 Strain
4,278,834 A 7/1981 Boundy
4,308,770 A 1/1982 MacDonald
4,315,391 A 2/1982 Piazza
4,364,206 A 12/1982 Wybauw
4,381,632 A 5/1983 Geitner
4,439,971 A 4/1984 Rutherford
4,549,831 A 10/1985 Lautenschlager
4,559,410 A 12/1985 Hostetter
D283,783 S 5/1986 Park
4,592,175 A 6/1986 Werner
4,611,841 A 9/1986 Ravinet
4,631,881 A 12/1986 Charman
4,642,418 A 2/1987 Menchetti
4,782,972 A 11/1988 Wenkman et al.
4,813,726 A 3/1989 Ravinet
4,854,094 A * 8/1989 Clark ..... E04B 1/3483 52/234
4,875,312 A 10/1989 Schwartz
4,910,932 A 3/1990 Honigman
4,930,273 A 6/1990 Papesch
5,038,535 A 8/1991 Van Praag, III
5,172,529 A 12/1992 Van De Riet
5,245,474 A 9/1993 Chabassier et al.
5,386,788 A 2/1995 Linker et al.
5,402,608 A 4/1995 Chu
5,425,520 A 6/1995 Masumoto
5,555,681 A 9/1996 Cawthon
5,619,826 A 4/1997 Wu
5,647,181 A 7/1997 Hunts
5,688,003 A 11/1997 Beale
5,698,818 A 12/1997 Brench
5,741,032 A 4/1998 Chaput
5,768,845 A 6/1998 Beaulieu et al.
5,787,665 A 8/1998 Carlin et al.
5,788,395 A 8/1998 Grieser et al.
5,960,592 A 10/1999 Lilienthal, II et al.
6,101,773 A 8/2000 Chau et al.
6,119,427 A * 9/2000 Wyman ..... E04B 1/12 52/127.11
6,178,701 B1 1/2001 De Paepe et al.
6,279,287 B1 8/2001 Meadows
6,523,868 B1 2/2003 Timothy
6,523,869 B1 2/2003 Jensen et al.
6,530,630 B2 3/2003 Herbeck et al.
6,568,723 B2 5/2003 Murphy et al.
6,609,338 B2 8/2003 Hightower
6,626,017 B2 * 9/2003 Herbeck ..... F16B 2/18 138/147
6,658,904 B2 12/2003 Herbeck et al.
6,662,508 B1 12/2003 Else
6,676,234 B2 1/2004 Herbeck et al.
6,786,009 B1 9/2004 McGunn et al.
6,892,498 B1 5/2005 Roman
6,955,204 B1 10/2005 Gilbert et al.
7,150,208 B2 12/2006 Debley
7,334,377 B2 2/2008 Dubensky et al.
7,495,181 B2 2/2009 Matsushita et al.
7,540,115 B2 6/2009 Metcalf et al.
7,665,775 B1 2/2010 Miller et al.
7,716,895 B2 5/2010 Fairorth et al.
7,922,223 B2 4/2011 Lawrence
7,954,294 B2 6/2011 Appleford
7,956,793 B2 6/2011 Puscasu et al.
8,474,193 B2 7/2013 Sutton et al.
8,514,354 B2 8/2013 Amimori et al.
8,677,698 B2 3/2014 Segall
8,803,107 B2 8/2014 Delpech et al.
2002/0095888 A1 7/2002 Winskye
2003/0035917 A1 2/2003 Hyman
2003/0082357 A1 5/2003 Gokay et al.
2006/0083866 A1 4/2006 Hanelt
2006/0277852 A1 12/2006 Mower et al.
2007/0044411 A1 3/2007 Meredith et al.
2007/0175115 A1 8/2007 Price
2008/0302027 A1 10/2008 Matsushita et al.
2008/0282623 A1 11/2008 Powell
2009/0107056 A1 4/2009 Kirilichin et al.
2009/0165401 A1 7/2009 Smalley, III
2009/0167971 A1 7/2009 Powers et al.
2009/0193740 A1 8/2009 Bennett
2010/0018131 A1 1/2010 Green
2011/0025973 A1 2/2011 Kaneiwa et al.
2011/0047912 A1 3/2011 Armijo
2011/0268925 A1 11/2011 Kagawa
2012/0162996 A1 6/2012 Ikeda
2013/0042556 A1 2/2013 Armijo
2013/0055669 A1 3/2013 Olszewski et al.
2013/0308085 A1 11/2013 Ikeda et al.
2014/0318036 A1 10/2014 Eom

FOREIGN PATENT DOCUMENTS

JP 200349541 12/2000
WO WO 2006001824 1/2006

* cited by examiner

RELOCATABLE HABITAT UNIT

RELATED APPLICATIONS

This application is a continuation of U.S. patent application Ser. No. 14/217,216 filed on Mar. 17, 2014, entitled "Relocatable Habitat Unit," and currently co-pending, which claims the benefit of priority to U.S. Provisional Patent Application Ser. No. 61/800,838 filed Mar. 15, 2013, entitled "Relocatable Habitat Unit.".

FIELD OF THE INVENTION

The present invention pertains generally to Relocatable Habitat Units (RHUs) for use in simulating an environment for a military combat training scenario. More particularly, the present invention pertains to an RHU that can be assembled and disassembled on-site, using panels that can be maneuvered, positioned and interconnected by no more than two men. The present invention is particularly, but not exclusively, useful as a system and method for the complete assembly of an RHU using only a single hand-operated tool.

BACKGROUND OF THE INVENTION

Military training must necessarily be conducted in an environment that will simulate anticipated combat operations as accurately as possible. For a comprehensive training program, this requires the ability and flexibility to relocate and set-up several different types of training environments. In general, training sites may need to selectively simulate either an urban, suburban, or an open terrain environment.

For a training site, the realism that can be attained when simulating a particular environment can be clearly enhanced by introducing indigenous persons (i.e. actors) into the training scenario. In addition to the indigenous persons, urban and suburban environments can be even more realistic when trainees are confronted by obstacles, such as buildings (e.g. habitats). In most instances, such structures can be relatively modest. Nevertheless, their integration into the training scenario requires planning.

Providing realistic buildings for a training environment requires the collective consideration of several factors. For one, the buildings need to present a visual perception accurate for the particular training scenario. Stated differently, they need to "look the part." For another, it is desirable that structures assembled on the training site be capable of relatively easy disassembly for relocation to another training site and subsequent use. The use of state-of-the-art movie industry special effects, role players, proprietary techniques, training scenarios, facilities, mobile structures, sets, props, and equipment, all contribute to the Hyper-Realistic™ training model and serve to increase the quality of training.

For military mountain locations such as the Marine Corps Mountain Warfare Center, near Bridgeport, Calif., the 8,000 feet elevation is accessible only by four-wheel drive vehicles. Some mountains, such as those in Fort Irwin, Calif., are accessible only by helicopter. Additionally, only non-permanent structures may be placed on the Marine Corps Mountain Warfare Center due to regulations, the nature of the military compound, and the environment. With this last point in mind, the ability to easily transport, assemble, and disassemble a building used as a training aide is a key consideration.

Heretofore, military combat training scenarios have been conducted either on open terrain, or at locations where there were pre-existing buildings or structures. The alternative has been to bring prefabricated components of buildings to a training site and then assemble the components to create the building. Typically, this has required special equipment, considerable man-hours of labor, and sometimes even requiring the assistance of Military Construction Units (MILCON); requiring significant military financial resources to erect and disassemble such "non-permanent" structures.

In light of the above, it would be advantageous to provide a training environment which can utilize the Hyper-Realistic™ combat environment at any on-site location in a variety of complex, tactically challenging configurations. It would be further advantageous to provide a training environment where the structures are field-repairable. This allows realistic visual feedback to trainees during live fire field exercise, while still allowing multiple training runs without the need to replace training structures.

It is an object of the present invention to provide a repairable construction set and method for assembling and disassembling an RHU in a variety of configurations, at a training site, with as few as two persons. Alternatively, it is an object of the present invention to provide a repairable non-permanent construction set, having the ability of off-site assembly for air transport to facilitate training in remote locations or at high altitudes for specialized military training without the need for MILCON. Still another object of the present invention is to provide a construction set that requires the use of only a single, hand operated tool for the assembly and disassembly of an entire RHU. Yet another object of the present invention is to provide a construction set for the assembly and disassembly of an entire RHU that is relatively simple to manufacture, extremely simple to use, and comparatively cost effective.

SUMMARY OF THE INVENTION

The Relocatable Habitat Unit (RHU) of the present invention is assembled using a plurality of substantially flat panels, designed to be modular, scalable, reconfigurable, and relocatable.

The RHU is based on a lightweight 4'×8' composite material panel system and engineered to assemble into multi-story, complex configurations with a single tool. The RHU panels are constructed with pultruded fiberglass reinforced plastic beams, bonded with wood, composite, or expanded polystyrene foam panels that are laser cut to replicate the look and texture of various building materials like brick, adobe, mud, wood, bamboo, straw, thatch, etc., sprayed with one-eighth inch of a fire retardant pro-bond and "sceniced" (Pronounced SEE-nicked; a movie industry term that means "aged" to look weathered). Materials and construction provide all-weather, long-lasting, fire-retardant structures suitable for year-round military training in all environments.

In a preferred embodiment, any interior or exterior panel can be interchanged. Common amenities such as windows, doors, stairs, etc. can be attached or installed to the RHU structure. Additionally, a variation of these modular panels can also be used to clad other structures, such as containers, wooden temporary structures, or permanent buildings. For this assembly operation, each panel includes male (M) and female (F) lock connectors. Specifically, these connectors are located along the periphery of each panel. Importantly, all of the (M) connectors can be engaged with a respective (F) connector using the same tool. Thus, an entire RHU can be assembled and disassembled in this manner. Further, each panel is sufficiently lightweight in order to be moved and positioned by one person. As a practical matter, a second person may be required to use the tool and activate the connectors as a panel is being held in place by the other person.

In detail, a construction set for use with the present invention includes a plurality of panels and only the one tool. Each panel has a periphery that is defined by a left side edge, a right side edge, a top edge, and a bottom edge. However, selected panels can have different configurations that include a door or a window. Still others may simply be a solid panel. In particular, solid panels are used for the floor and ceiling (roof) of the RHU. Furthermore, a panel can be omitted, leaving a void to facilitate an entry or exit to a higher or lower level when the RHU is utilized in the multi-story configuration. Each panel, regardless of its configuration, will include at least one (M) connector and at least one (F) connector that are located on its periphery.

In addition to the wall, floor, and ceiling panels, an embodiment of the construction set also includes corner connections and ceiling attachments. Specifically, corner connections are used to engage wall panels to each other at the corners of the RHU. The ceiling attachments, on the other hand, allow engagement of roof panels with the top edges of wall panels and can also be used to stack multiple levels of a RHU, creating complex multi-level urban structure designs. In the multi-level configuration, vertical corner posts and horizontal beams provide a similar function to the corner connections and ceiling attachments, and are used to construct a frame to support a plurality of panels.

The placement and location of male (M) and female (F) lock connectors on various panels of the construction set is important. Specifically, along the right side edge of each wall panel, between its top edge and bottom edge, the lock configuration is (FMMF). Along its left side edge, the lock configuration is (MFFM). Further, along the top edge the lock configuration is (MM), and along the bottom edge it is (M) or (F), depending on the connector of the floor panel.

Unlike the panels, the corner connections are elongated members with two surfaces that are oriented at a right angle to each other. The lock configurations for a corner connection are (F--F) along one surface and (-FF-) along the other surface. Like the corner connections, the ceiling attachments also present two surfaces that are at a right angle to each other. However, their purpose is different and, accordingly, they have a (FF) lock configuration on one surface for engagement with the top edge of a wall panel. They also have either a (MM) or a (FF) configuration along the other surface for connection with a ceiling panel.

Importantly, in addition to the above mentioned panels, connections, and attachments, the construction set of the present invention includes a single hand tool. Specifically, this hand tool is used for activating the various male (M) connectors for engagement with a female (F) connector, in addition to driving other required hardware. For the present invention, this tool preferably includes a hex head socket, a drive that holds the hex head socket, and a ratchet handle that is swivel-attached to the drive.

For assembly of the RHU, the first task is to establish a substantially flat floor. This is done by engaging male (M) connectors on a plurality of floor panels with female (F) connectors on other floor panels. The floor is then leveled using extensions that can be attached to the floor panels at each corner. Next, a wall is erected around the floor of the RHU by engaging a male (M) connector on the right side edge of a respective wall panel with a female (F) connector on the left side edge of an adjacent wall panel. Recall, the lock configurations on the left and right edges of wall panels are, respectively, (FMMF) and (MFFM). Additionally, the bottom edge of each panel in the wall is engaged to the floor using mutually compatible male (M) and female (F) connectors. Finally, the ceiling assembly of the RHU is created by engaging male (M) connectors on ceiling panels with female (F) connectors on other ceiling panels. The ceiling attachments are then engaged to the assembled ceiling. In turn, the ceiling attachments are engaged to the top edge of a wall panel using mutually compatible male (M) and female (F) connectors. All connections for the assembly of the RHU are thus accomplished using the same tool.

In a preferred embodiment all panels are interchangeable. A frame is constructed consisting of vertical corner posts and horizontal beams (analogous to the corner connections and ceiling attachments), each formed with M and F lock connectors along their length that complement the lock connectors on the panels. Once the frame is in place, the panels may be configured and reconfigured as needed. Vertical corner posts and horizontal beams are also secured together using the single tool and additional hardware. By assembling a plurality of RHUs in this manner, the RHUs can be configured in any complex configuration that will best simulate the indigenous environment desired. A plurality of RHUs can be placed side-to-side, back-to-back, offset, stacked, or staggered to create a multi-level scalable structure. A simple repair kit provides quick easy patching of the composite materials.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
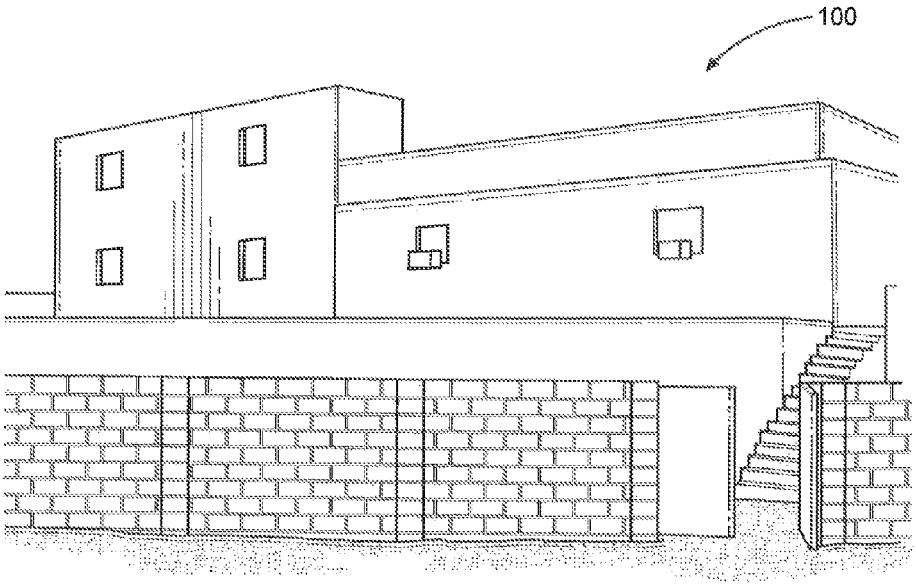
FIG. 1 is a front view of a preferred embodiment of a multi-story relocatable habitat unit, "sceniced" to resemble a fortress, showing the use of compound walls, and other features.

Referring initially to FIG. 1, a preferred embodiment of a multi-story relocatable habitat unit ("RHU") of the present invention is shown and generally designated 100. As will be explained more fully below, the entirety of the RHU is constructed using five basic parts and a single tool and can be sceniced to resemble a real world tactical environment. Stage production techniques are utilized to provide a real world environment, increasing the quality of tactical training while remaining flexible with the execution and assembly.

Figure 2:
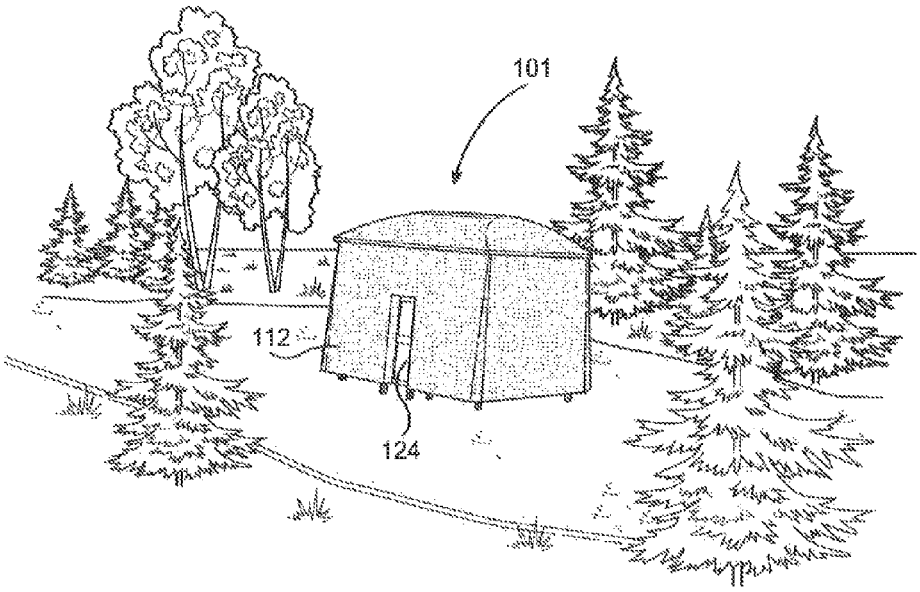
FIG. 2 is an alternative embodiment of a single story construction of the present invention showing another manner in which the relocatable habitat unit can be "sceniced" with additional props to resemble real world tactical environments.

Referring to FIG. 2, a preferred embodiment of a single level RHU of the present invention is shown a generally designated 101. RHU 101 is shown "sceniced" as a hut that might be found in a desert or grassland environment used to simulate real world tactical training. In this Figure a door 124 is shown formed into a wall panel 112, as will be discussed more fully below. As can be seen in this Figure, wall panels 112 (explained more fully below) can be built to resemble buildings other than square structures. The illusion of the RHU 101 having a wider base than top is provided by adding more material to the bottom portion of the panels 112 than at the top.

Figure 3:
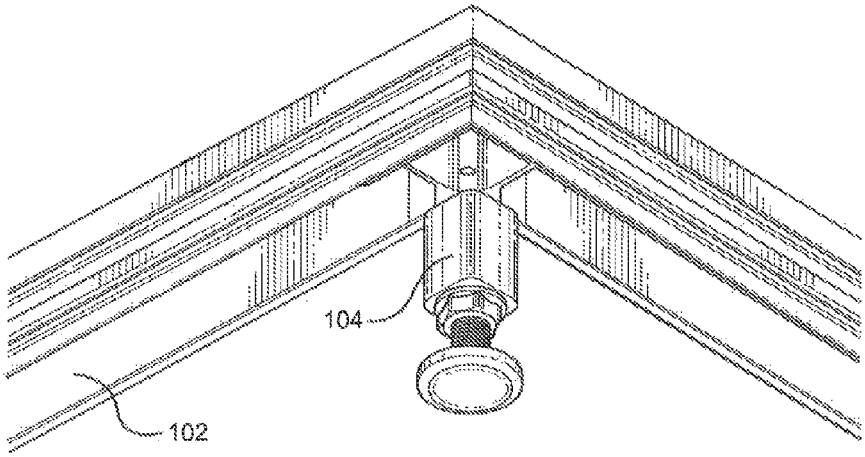
FIG. 3 is a perspective view of an adjustable foot module as it is mounted to the underside of a floor panel.

Referring now to FIG. 3, the construction of the RHU 100 begins with one or more floor panels 102, a portion of which is shown in this Figure with a single adjustable foot module 104 attached. Adjustable foot module 104 is utilized to level the floor panel in relatively flat terrain (preferably less than four percent grade). A single tool (not shown), typically a hex tool and a common ratchet can be employed to secure or adjust every attachment in the RHU 100.

Floor panels are interchangeable with other floor panels and generally sturdy, being formed of a metal frame such as aluminum, steel, other suitable material, with a wooden or composite floor. Each floor panel 102 is designed to withstand tactical training, on the first level or the second level of RHU 100.

Figure 4:
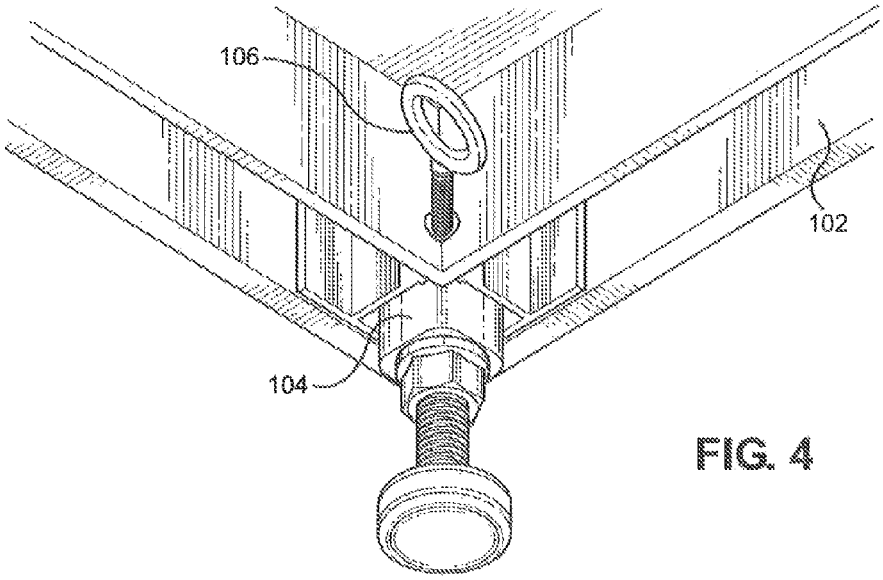
FIG. 4 is a bottom perspective view of the underside of the corner of a floor panel, showing the set screw that secured the adjustable foot module in place.

Referring now to FIG. 4, the underside of the floor panel 102 is shown where adjustable foot module 104 is inserted into a receiver formed in the floor panel 102 and secured by a set screw 106. The adjustable foot module 104 can be used on any corner of any floor panel 102 in use.

Figure 5:
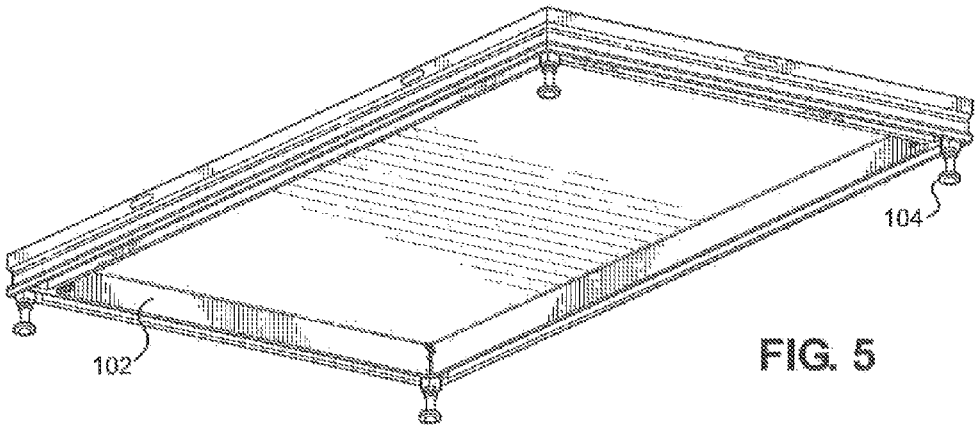
FIG. 5 is a perspective view of the bottom of a single floor panel, showing the frame, floor board, four adjustable foot modules, and the lock connectors on the visible sides.

Referring to FIG. 5, the underside of a floor panel 102 is shown with four adjustable foot modules 104 inserted into a receiver and secured allowing the user to level the floor panel on the terrain. Each of the floor panels is individually leveled with the adjacent floor panels 102 to maintain a flat platform on which to construct the remainder of the RHU 100.

Figure 6:
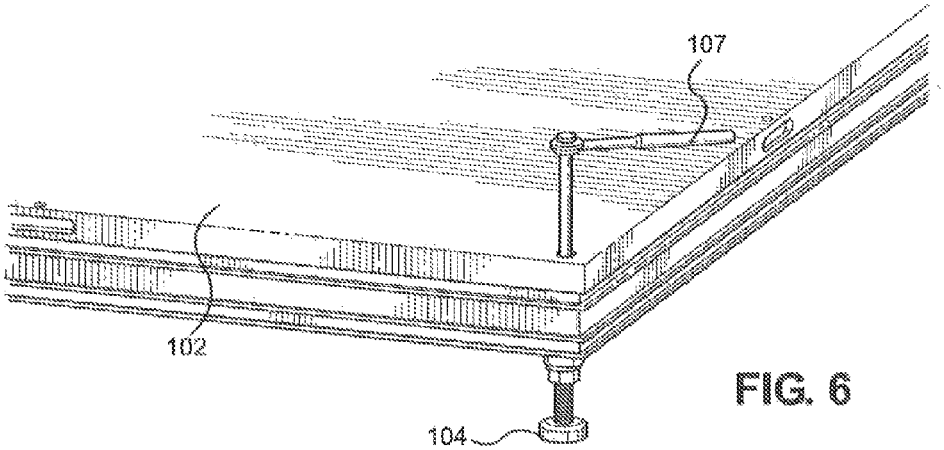
FIG. 6 is a perspective view of the top of a corner of a floor panel, showing a lock connector and the tool used to adjust the height of the adjustable foot module.

Referring to FIG. 6, the tool 107 is inserted and engages with the adjustable foot module 104 to adjust the height and level of the floor panel 102. Tool 107 is a notionally a common ratchet set with a hex tool, similar to an Allen wrench and will be used throughout construction of the RHU 100.

Figure 7:
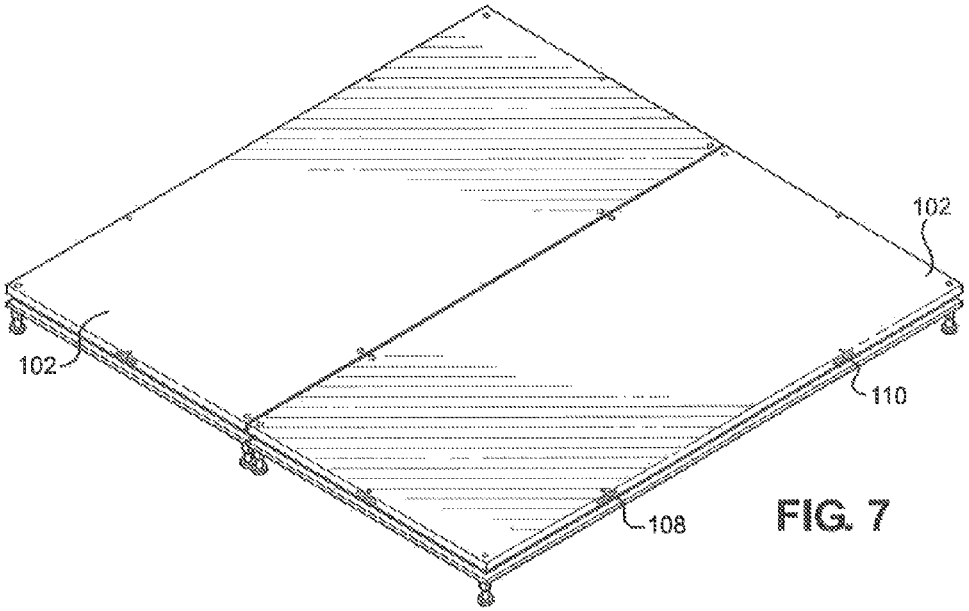
FIG. 7 is a perspective view of two floor boards after being leveled using the adjustable foot modules and connected together with each floor panel's respective lock connectors.

Referring to FIG. 7, multiple floor panels 102 can then be leveled and attached along their adjacent edges through the use of male (M) lock connectors 108 and female (F) lock connectors 110. Two floor panels 102 have been connected together, forming a larger floor that will form part of the base of RHU 100. In a preferred embodiment of RHU 100, any practical number of floor panels 102 can be connected to create a larger floor plan. Tool 107 is used to connect and disconnect lock connectors 108 and 110, and secure corner posts and ceiling beams to the RHU 100.

Figure 8:
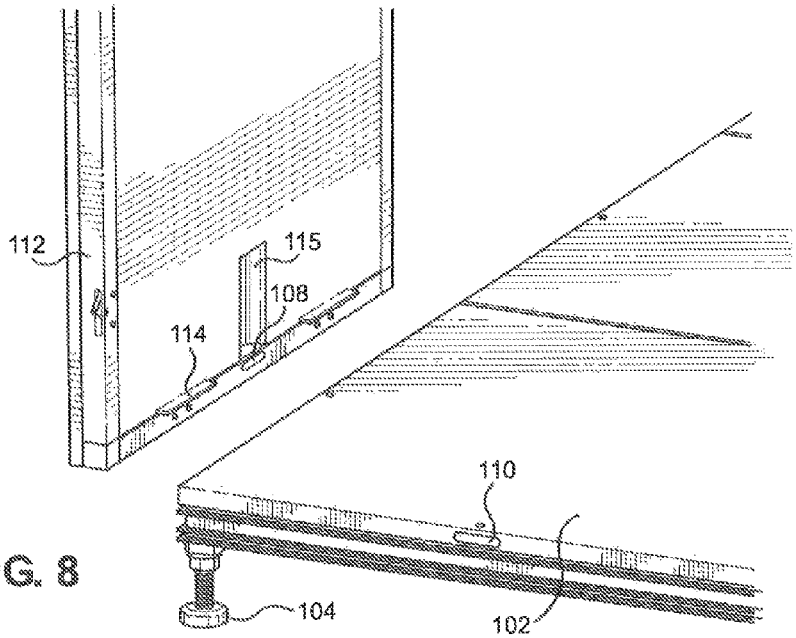
FIG. 8 is a perspective is a perspective view of a wall panel as it is attached to the edge of a floor panel, showing the access port for actuating the lock connector on the bottom edge of the wall panel, and the ledges that maintain the wall panel's position on the floor panel allowing the user to connect the wall panel to the floor panel with the lock connectors.

Referring to FIG. 8, a wall panel 112 is shown as it would be attached to the edge of a floor panel 102. The wall panel has ledges 114 that aid in supporting the weight of the wall panels 112, as the user is securing the M lock 108 on the base of the wall panel 112 to an F lock 110 (not visible from this angle) on the edge of the floor panel 102. Each of the wall panels 112 has at least one M lock 108 or at least one F lock 110 along the interior face of the bottom edge, where the wall panel 112 comes in contact with floor panel 102. An access port 115 provides the user with access to fit the tool 107 and actuate the M lock 108, as depicted by FIG. 9.

Figure 9:
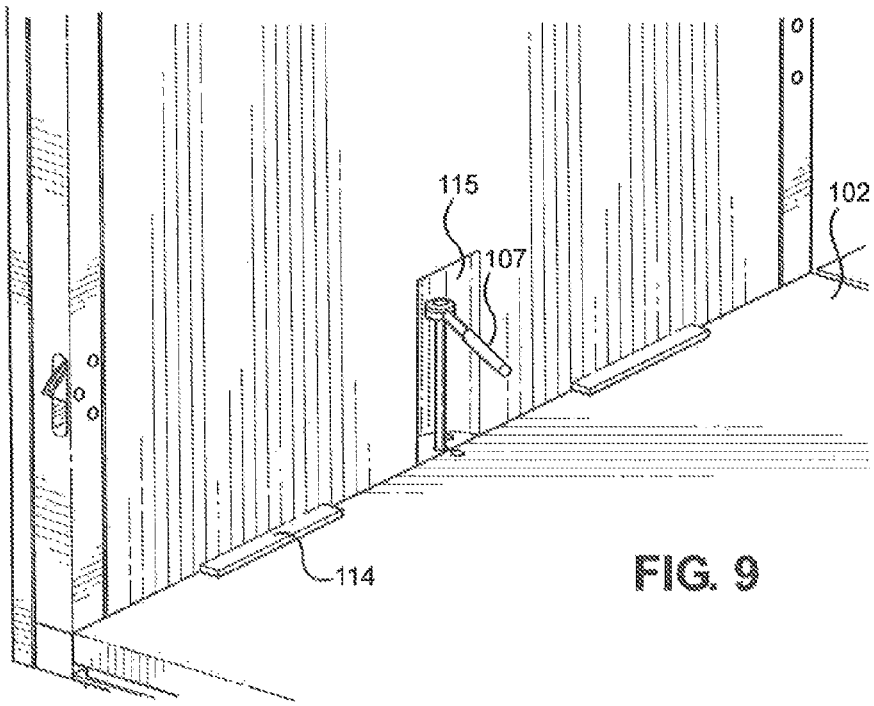
FIG. 9 is a perspective view of a wall panel as attached to a floor panel using the lock connectors, showing the ledges on the bottom edge of the wall panel holding the wall panel in place, and the tool as it would be inserted to actuate the lock connectors.

FIG. 9 shows a common ratchet as tool 107 actuating the M lock 108. Shown are ledges 114 formed into the frame of wall panel 112 that help support the weight of the wall panel 112 during construction. The ledges 114 are not intended to be critical load bearing members once the frame (shown in FIG. 10) of the RHU 100 is complete.

Figure 10:
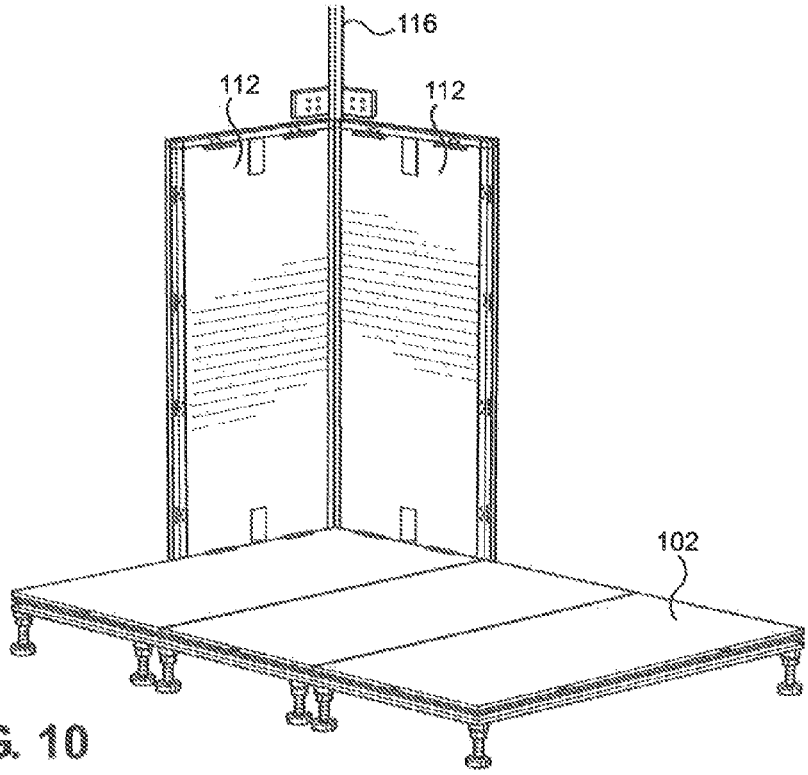
FIG. 10 is a perspective view of three floor panels connected forming a floor of a relocatable habitat unit, with two wall panels connected to the floor panels and to a corner post.

Referring to FIG. 10, two wall panels 112 are shown connected to the floor panels 102 through the use of the M locks 108 and F locks 110 (shown in FIG. 9). As the wall panels 112 are secured in place, a corner post 116 is connected to the first wall panel 112 through the use of the M locks 108 and F locks 110. The corner post 116 is an elongated, metal member with a roughly square cross section. At least two of the adjacent sides that meet wall panels 112 at a given corner have M locks 108 and F locks 110 disposed about the length of the corner post 116. In an embodiment, a corner post 116 may be formed with appropriate lock connectors 108 and 110 as needed on more than two adjacent surfaces along the corner post's 112 length to accommodate additional designs. Such an embodiment might require a T-shaped intersection where three walls come together, or even four walls, as required.

Figure 11:
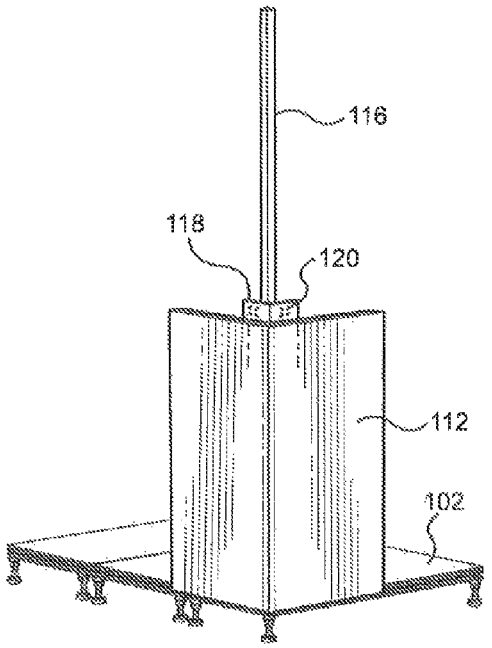
FIG. 11 is a perspective view of the outside of corner of FIG. 8, showing the interaction of the corner post as it connects to the two wall panels forming a corner of the relocatable habitat unit.

Referring to FIG. 11, an opposing view from that of FIG. 10 is shown. Corner post 116 is connected along its length to two wall panels 112 with the use of the M locks 108 and F locks 110 disposed one the edges. This Figure also shows the two flanges 118 orthogonally disposed on adjacent sides of corner post 116 at approximately the height of the wall panels 112. Flanges 118 are formed with holes 120 to accept hardware 122 that will ultimately secure ceiling beams (discussed below).

Figure 12:
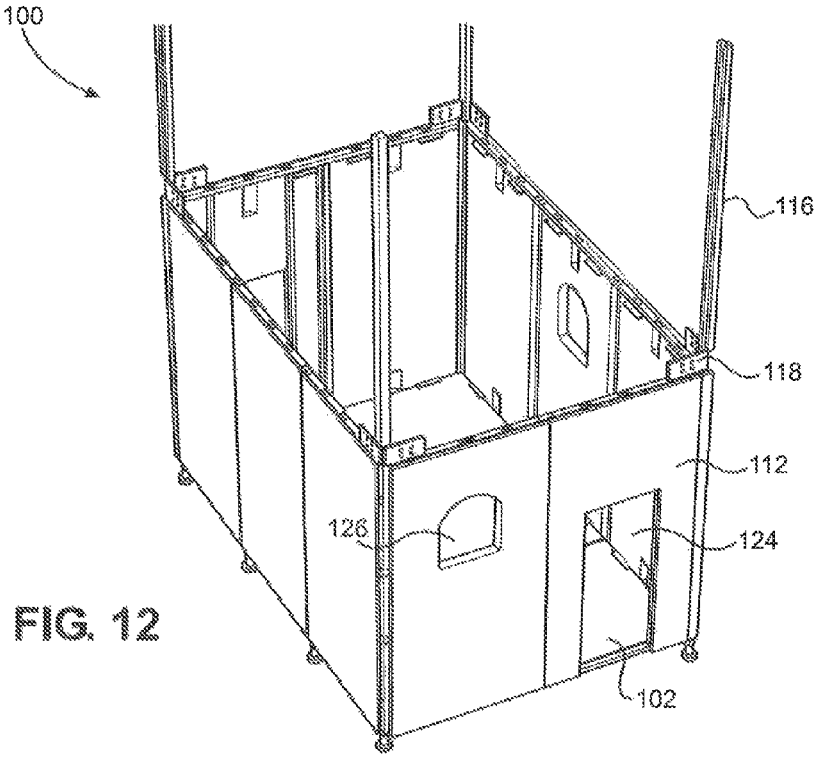
FIG. 12 is a perspective is a top perspective view of the bottom floor of a relocatable habitat unit prior to installation of the second story, showing eight wall panels installed forming the walls of the relocatable habitat unit, with two doors, and two windows.

Referring to FIG. 12, ten wall panels 112 are erected around the edges of the three floor panels 102 that form the floor of RHU 100. Four corner posts 116 are utilized to support the four corners of the first floor of the RHU 100. As shown, the wall panels 112 can be formed with one of several amenities common in a typical building. Amenities such as a door 124 or a window 126 can be formed into the wall panels 112 as needed. Additionally, the wall panels are interchangeable, being identically built and reconfigurable once the RHU 100 is complete.

In a preferred embodiment, wall panels 112 are formed of a frame composed of pultruded fiberglass reinforced plastic beams, bonded with wood, composite, or expanded polystyrene foam panels that are laser cut and sceniced to replicate the look and texture of various building materials like brick, adobe, mud, wood, bamboo, straw, thatch, among other materials.

Because tactical military training often requires live ordnance, panels may become damaged. The ability to repair or quickly reconfigure a wall panel 112 from a solid wall to a door 124 or window 126 panel is of great utility saving considerable time and money.

Figure 13:
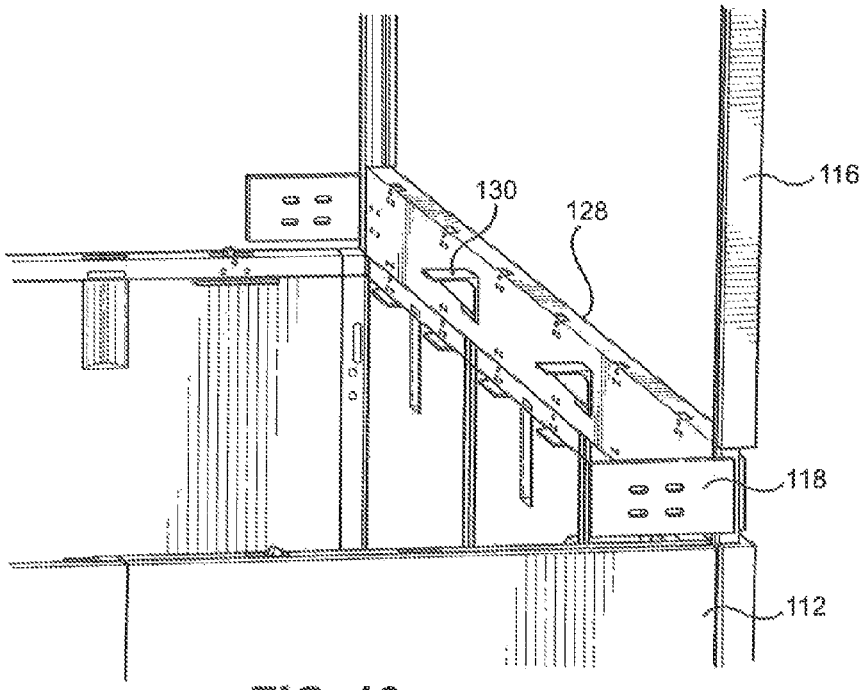
FIG. 13 is a view of two corner posts as they interact with a ceiling beam, showing the flanges formed to the corner posts that connect to the ceiling beams, and the ledges formed into the ceiling beam for support of the second story floor.

Referring now to FIG. 13, to construct the ceiling attachment assembly, a ceiling beam 128 is secured between flanges 118 in order to both provide structural support to the wall panels 112, but also to support the second floor of RHU 100. Tabs 130 are also formed to the interior of beam 128 supplying additional support to the floor panels 102 (shown in FIGS. 3-12) that will be employed as the ceiling, or floor of the second story.

Figure 14:
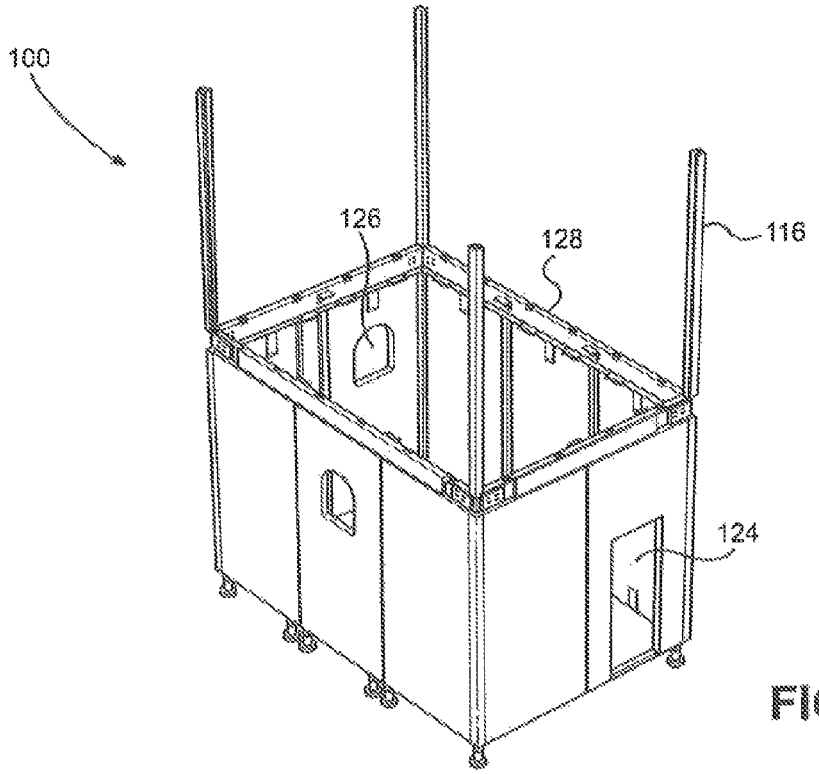
FIG. 14 is a top perspective view of a complete first story of a relocatable habitat unit prior to the installation of the second story floor, showing four ceiling beams installed between the four corner posts for support of the second floor.

Referring now to FIG. 14, a top perspective view of the first story of the RHU 100 after the remaining ceiling beams 128 are installed creating the ceiling attachment assembly to which the ceiling or next story will be secured is shown.

Figure 15:
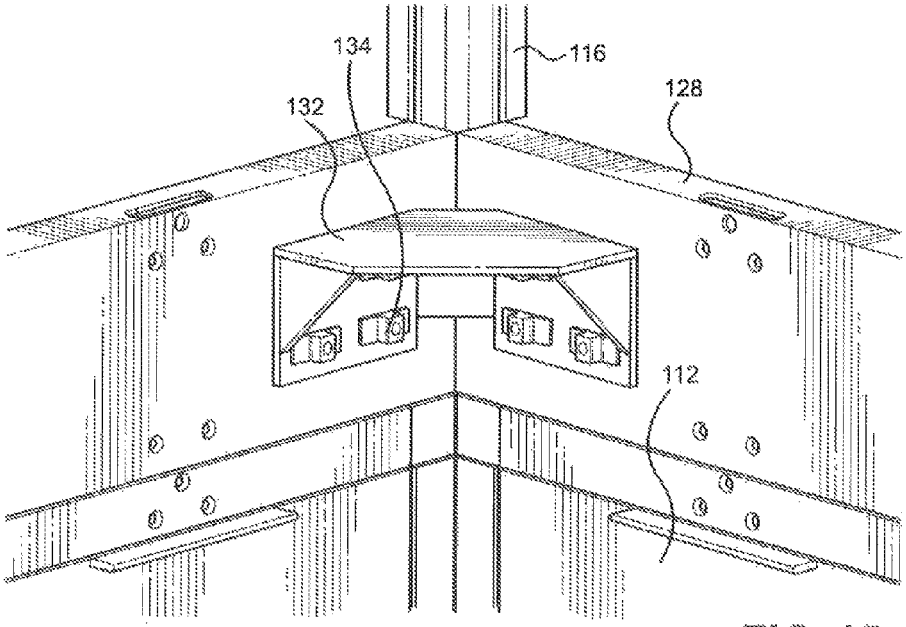
FIG. 15 is a perspective view of the interior of the corner post where the flanges and ceiling beams meet, showing a corner bracket installed, with the hardware inserted through the flanges, through the ceiling beams, and into the cage nuts formed onto the interior of the corner bracket.

Referring to FIG. 15 an interior view of a corner bracket 132 is shown installed in the corner where two ceiling beams 128 meet. The corner bracket 132 is formed with at least two orthogonal faces that meet flanges 118 (shown in FIGS. 11-13), and holes 134 sized to receive hardware 136 (shown in FIG. 16). Hardware is notionally a bolt, capable of being driven by tool 107, maintaining the simplicity of construction. Additionally, holes 134 in corner bracket 132 can either be internally threaded or alternatively be equipped with cage nuts connected or otherwise formed to the interior of the corner bracket 132. In an embodiment, just as tabs 130 assist in supporting the floor panels 112 of the second story (or ceiling of the first story), the tops of corner bracket 132 are formed to assist in the support of the same.

Figure 16:
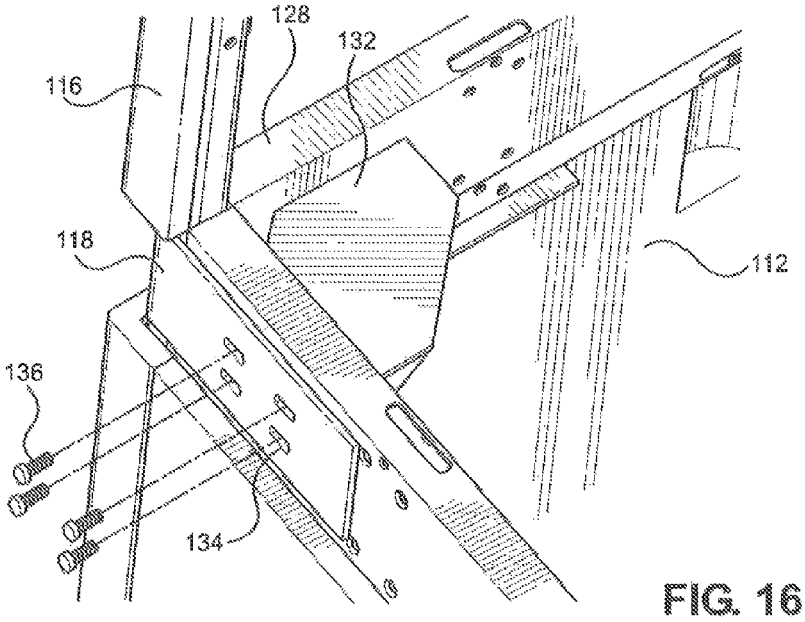
FIG. 16 is a perspective view of the top of a corner bracket as installed in a relocatable habitat unit, showing the interaction of two ceiling beams, corner post, and the top of the corner bracket that also serves to support the second story floor.

Referring to FIG. 16, a perspective view of the top of a corner bracket 132 is shown as installed between two ceiling beams 128. Hardware 136 is more clearly shown here as it is inserted to secure the components together.

Figure 17:
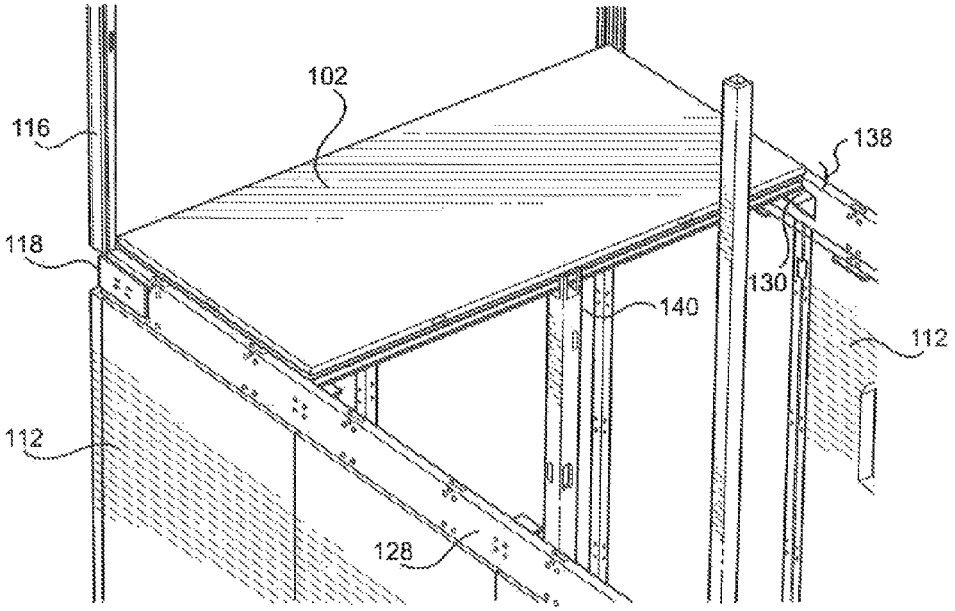
FIG. 17 is a top view of the installation of the second story floor, showing the lock connectors and the interaction of the edges of the floor panel as is lies atop the ceiling beam flanges and the corner brackets, in addition to a four by four support post installed to support the second story.

Referring now to FIG. 17, the beginning of installation of the second story floor of the RHU 100 is shown, with the addition of a first floor panel 102. Floor panels on a second story of an RHU 100 do not physically attach to the ceiling beams 128, but rather rest on the tabs 130 and the corner brackets 132 (shown in FIGS. 15-16). The top surface of the tabs 130 and the corner brackets 132 lies below the top of ceiling beams 128 creating a ridge 138 that helps maintain the position of floor panels 102 in use as a second story floor of RHU 100. In order to maintain integrity of the floor panels 102, each of the panels 102 in use is connected to the adjacent floor panel 102 with the use of lock connectors 108 and 110.

This Figure also shows the addition of support post 140 as it is installed to provide additional support to the floor panels 102 as they are installed on the second floor and will support the intersection of the three floor panels 102 in use in this embodiment of RHU 100.

Support post 140 is provided to create a more secure upper floor. As the surface area of a second story of a multi-level RHU 100 increases, the amount of support to maintain a level second floor also increases. Support post 140 is notionally a four-by-four beam made from any of a number of materials from a composite to metal or wooden members. While weight is a concern, the more important aspect is safety and security of RHU 100.

Figure 18:
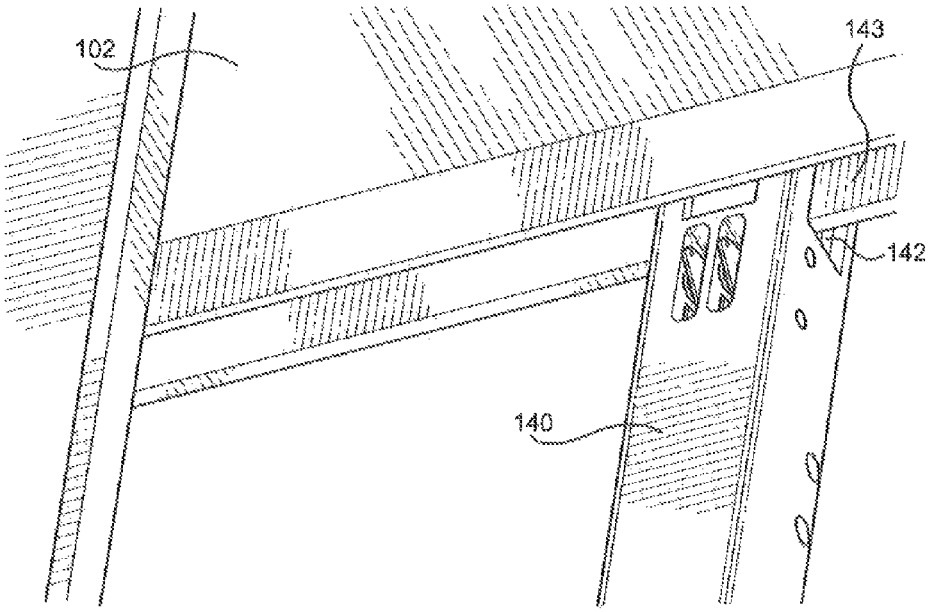
FIG. 18 is a perspective view of the underside of a second story floor panel where the four-by-four support post is installed.

FIG. 18 is a perspective view of the interaction of the support post 140 with the bottom of the floor panel 102. The support post 140 has a registration pin (not shown) in the bottom, that fits into the registration hole (not shown) in the floor panel 102. The registration hole indicates a strong point in the floor, generally positioned over an intersection of floor panels 102 where the increased support of the adjustable foot module 104 (shown in FIGS. 3-7) is located. Thus, support post 140 transfers the load from the intersection of second story floor panels 102, to the ground through the foot module 104, decreasing the sheer stresses applied to the floor panels 102 that comprise the second floor of RHU 100.

Figure 19:
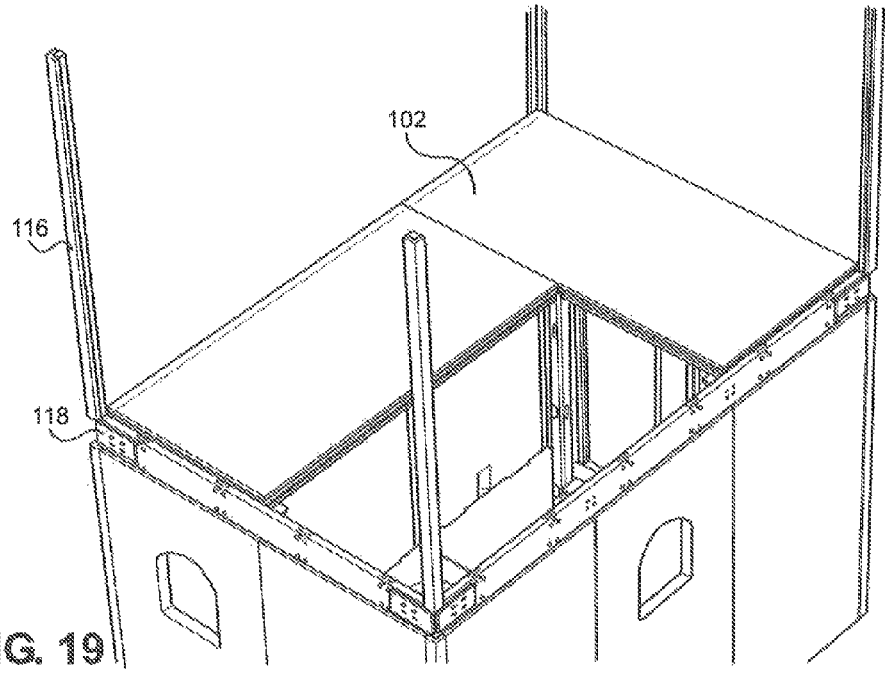
FIG. 19 is perspective view of the top of a partially constructed relocatable habitat unit showing the installation of a second floor panel for the second story, offset orientation of the second story floor panels, and the location and interaction of the four-by-four support post.
Figure 20:
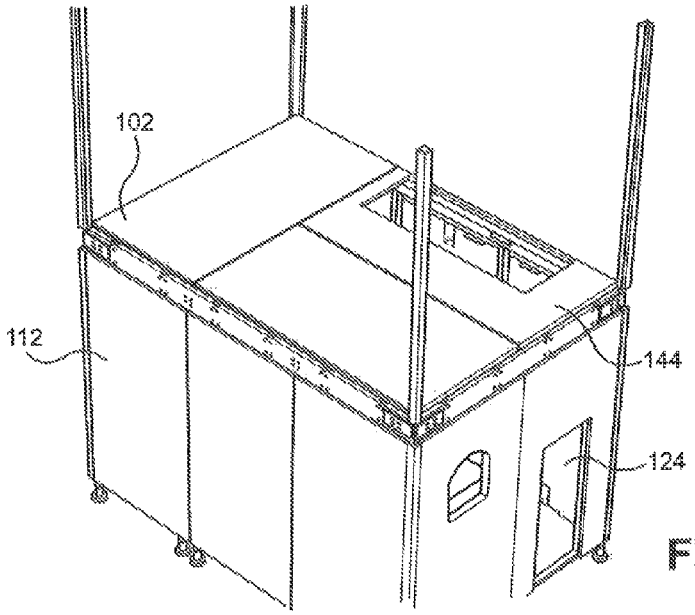
FIG. 20 is a perspective view of the top of the partially constructed relocatable habitat unit showing the installation of the third second story floor panel having a void adapted to accept a staircase.

Notches 142 formed in the top of the support post 140 are sized to accept the rails 143 formed in the bottom of the second story floor panel. The remaining floor panels 102 are intended to be oriented 90° from the first panel, as shown in FIGS. 19 and 20. This scheme of manipulating the orientation of the second story floor panels 102 more evenly distributes the loads applied to the second story and ensures a more structurally sound RHU 100. In an embodiment, it is desirable to support each second story floor panel 102 about all four corners.

Referring to FIG. 19 a second floor panel 102 is installed on the second story floor of RHU 100, supported on each corner and connected to the adjacent floor panel 102 with lock connectors 108 and 110.

In FIG. 20, the third and final second floor panel 102 installed on the second story floor of RHU 100 is shown, this time modified as a stairwell panel 144, providing a means for installation of a staircase 146 (shown in FIG. 22) and access to the second story of the RHU 100.

Figure 21:
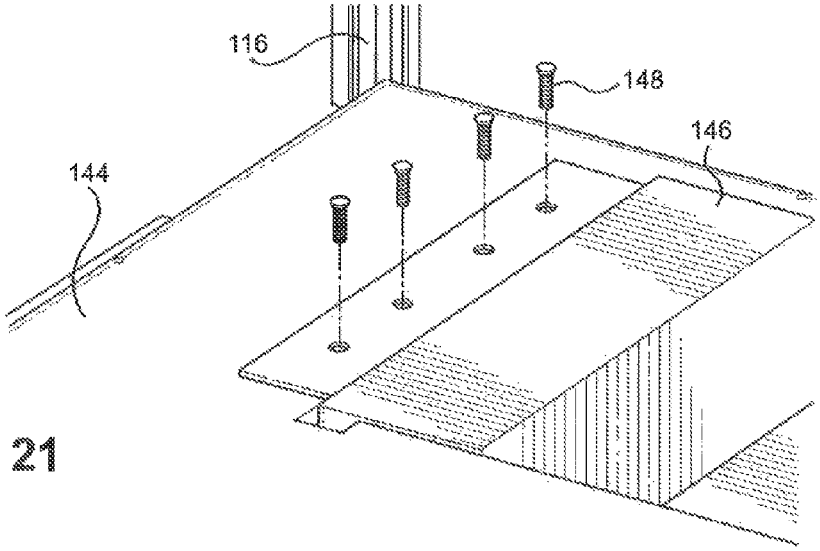
FIG. 21 is a perspective view of the installation of the hardware for securing the top of the staircase following installation in the relocatable habitat unit.

FIG. 21 shows the close up of the installation of a staircase 146, and hardware 148 as would be used to secure the staircase 146 to the stairwell panel 144.

Figure 22:
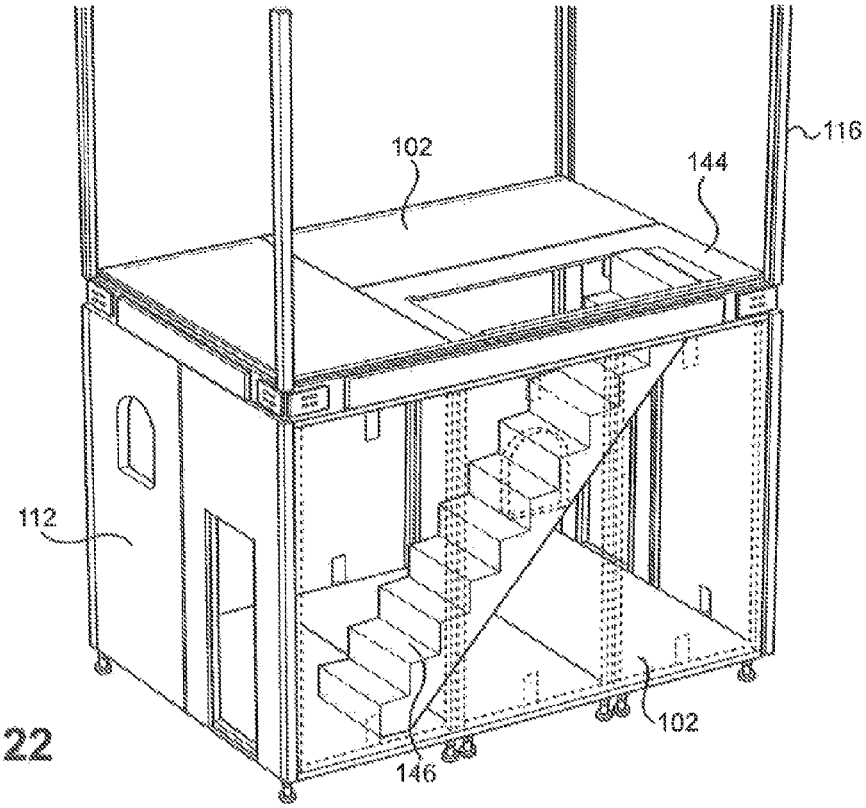
FIG. 22 is a perspective side view of a completed first story of a relocatable habitat unit showing a look-through view of the interior of the first floor with a staircase installed for access to the second floor.

Referring to FIG. 22, a side perspective of an almost complete RHU 100 is shown with a look-through to the staircase 146 and the completed first floor.

Figure 23:
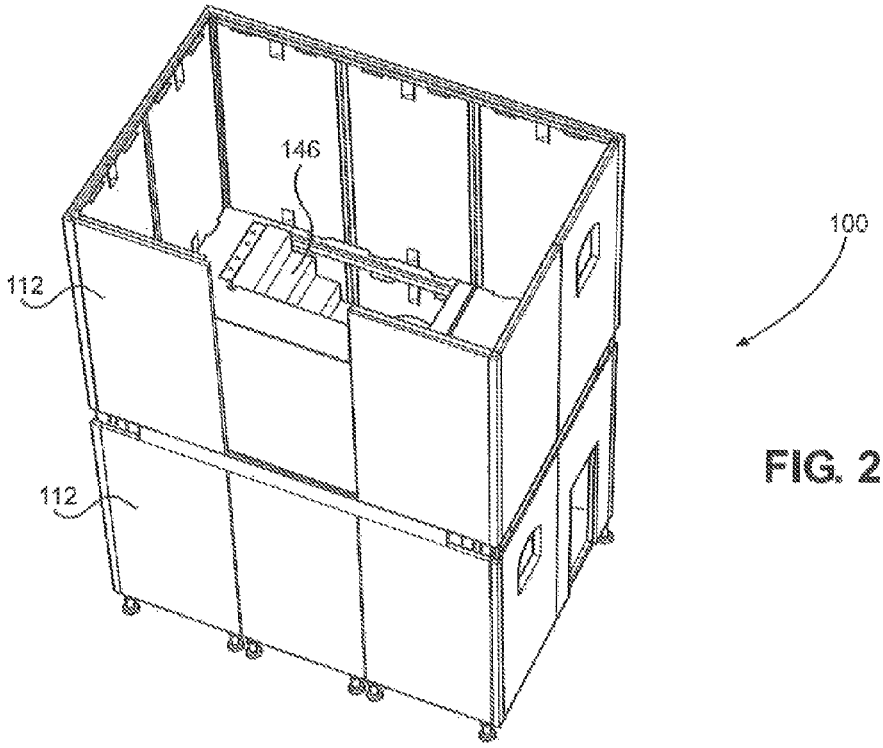
FIG. 23 is a perspective view of the top of the nearly completed second story of the relocatable habitat unit showing the top access of the staircase and nine of the ten required panels for the top floor.

Referring to FIG. 23, construction of the walls, using additional wall panels 112 continues as the second story is shown nearly enclosed with nine out of ten wall panels 112 installed. As before, the corner posts secure to adjacent wall panels 112 using lock connectors 108 and 110, in the same manner in which the lock connectors 108 and 110 are used to secure adjacent wall panels 112 together.

Figure 24:
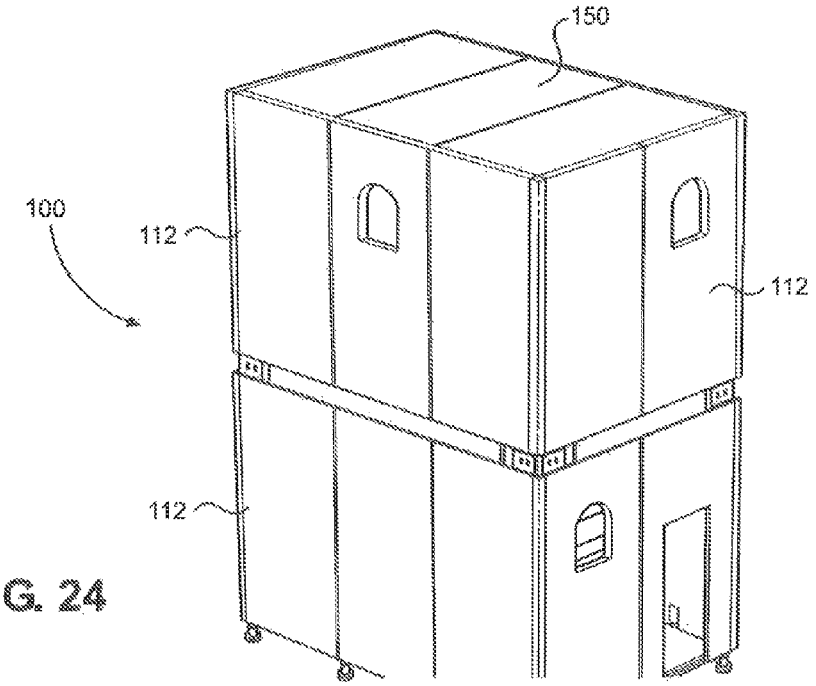
FIG. 24 is a perspective view of a completed two story relocatable habitat unit showing the roof panels installed on top of the second story.

Referring to FIG. 24, flat roof panels 150 are installed in the same manner in which the floor panels 102 were installed to create the floor of the second story. All flat roof panels 150 are identical and are substantially similar to floor panels 102. Like floor panels 102, flat roof panels 150 have male lock connectors 108 on two sides and female lock connectors 110 on two sides. With the wall panels 112 locked into the floor, the lock connectors 108 and 110 in the wall panels 112 will be the correct gender to mate with the roof panels 150. Note the position of the wall locks and rotate the roof panel to mate with them. The tool 107 (shown in FIGS. 6 and 9) is again used to actuate the individual male lock connectors 108 to lock the panels 112 and 150 into place.

Figure 25:
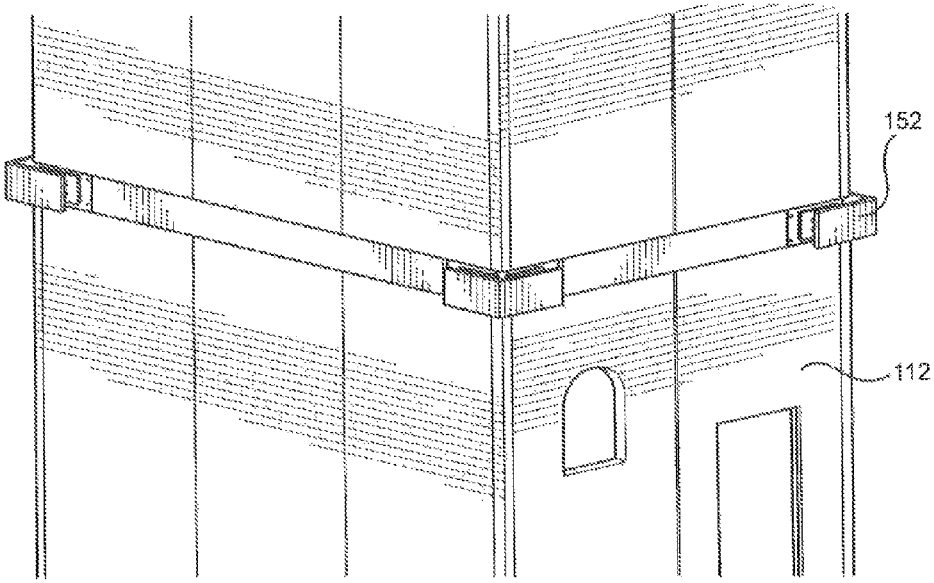
FIG. 25 is a side view of the installation of the corner post covers that magnetically adhere to the corner post flanges and complete the exterior finish.

The last step in the process of construction of RHU 100 is the addition of the foam corner pieces 152 as shown in FIG. 25. Foam corner pieces are formed with a magnetic backing that adheres to the exterior of flanges 118 (shown in FIGS. 11-13) on corner posts 116 (shown in FIGS. 10-23). Alternatively, the foam corner pieces 152 may be attached by utilizing snap locks, hook and loop fasteners, or any other similar fastening methods known in the art.

Figure 26:
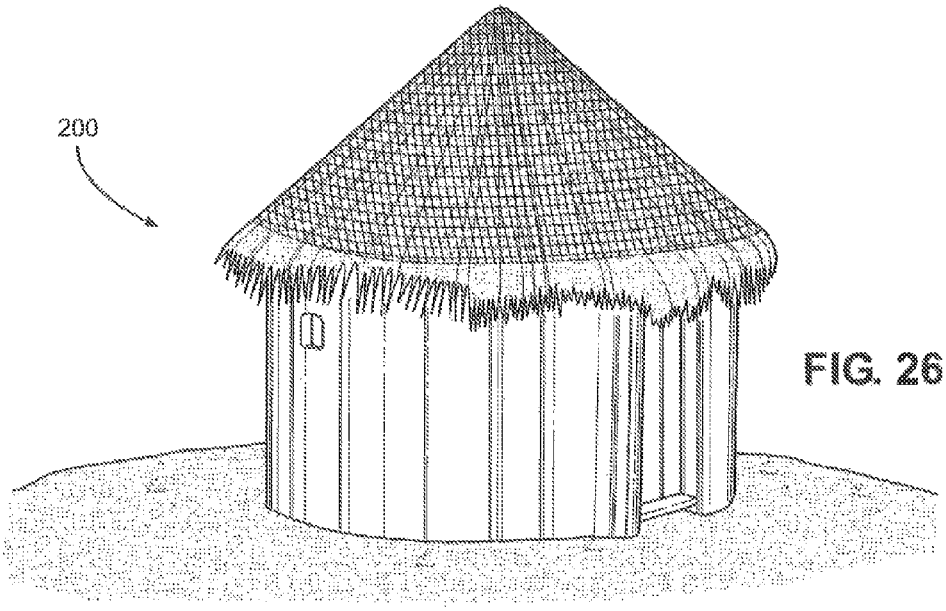
FIG. 26 is a perspective view of the side of a preferred embodiment of the present in invention showing the one of the many ways in which the relocatable habitat unit can be "sceniced" to resemble a real world building, yet still use the basic units of construction discussed herein.

Referring to FIG. 26, an alternative preferred embodiment of RHU of the present invention is shown and generally designated 200. RHU 200 is a round construction, resulting from the ability to vary the shape of the roof panels 150 and the floor panels 102. In an embodiment, the wall panels 112 need not be symmetrical or uniformly thick throughout their construction adding an illusion that the building is not perfectly square as in RHU 101 of FIG. 2. While the shape and cut of the panels that comprise the round RHU 200 are not exactly the same size or shape as the floor panels 102, wall panels 112, and roof panels 150, the same concepts and mechanisms are at work. Assembly and disassembly of RHU 200 is as fast and easy and uses the same tool 107 as above.

While the particular Relocatable Habitat Unit 100 of the present invention as herein shown and disclosed in detail is fully capable of obtaining the objects and providing the advantages herein before stated, it is to be understood that it is merely illustrative of the presently preferred embodiments of the invention. No limitations are intended to the details of construction or design herein shown other than as described in the appended claims.

What is claimed is:

1. A construction set for a relocatable habitat unit for use in simulating an environment for military combat training, the construction set comprising:

a plurality of interchangeable floor/roof panels having
- a periphery defined by a left side edge, a right side edge, a top edge, and a bottom edge,
- a plurality of rails formed on a bottom surface of each interchangeable floor/roof panel adjacent the periphery,
- at least one adjustable foot module receiver formed in the bottom surface of each interchangeable floor/roof panel,
- at least one access hole located on the top of each interchangeable floor/roof panel and positioned collinear with the adjustable foot module receiver, and
- a means to lock the interchangeable floor/roof panels, disposed on the periphery of the interchangeable floor/roof panels, and a plurality of wall panels having
- a periphery defined by a left side edge, a right side edge, a top edge, and a bottom edge,
- a plurality of ledges located near, and parallel to, the bottom edge and top edge of the wall panels, and
- a means to lock the wall panels, disposed on the periphery of the wall panels; and a plurality of corner posts having
- an elongated member with an approximately square cross-section,
- a plurality of flanges orthogonally disposed on adjacent sides of the elongated member, and
- a means to lock the corner posts;

a plurality of horizontal ceiling beams having tabs formed to the interior of the ceiling beam configured to support an edge of the interchangeable floor/roof panels, and a means to lock the horizontal ceiling beams, and wherein the plurality of horizontal ceiling beams secured between corner post flanges; and a plurality of corner brackets having a first vertical plate formed with a plurality of holes orthogonally arranged and fixedly attached to a second vertical plate formed with a plurality of holes, and a horizontal top plate arranged perpendicular and fixedly attached to the first vertical plate and second vertical plate and configured to attach to at least one ceiling beam to support a floor panel, wherein the means to lock the interchangeable floor/roof panels, the means to lock the wall panels, and the means to lock the corner posts are configured to lock together.

2. The construction set of claim 1, wherein the interchangeable floor/roof panel further comprises:
a frame;
a panel formed within the frame; and
an access port formed into the panel to access and actuate the means for locking the interchangeable floor/roof panel.

3. The construction set of claim 2, wherein the wall panel further comprises:
a frame;
a panel formed within the frame; and
an access port formed into the panel to access and actuate the means for locking the wall panel.

4. The construction set of claim 3, wherein the interchangeable floor/roof panel is used as a floor panel.

5. The construction set of claim 4, wherein the interchangeable floor/roof panel is used as a roof panel.

6. The construction set of claim 5, further comprising at least one adjustable foot module having an adjustable height and a means to adjust the adjustable height, the at least one adjustable foot module is received by the at least one adjustable foot module receiver and wherein the at least one access hole of the interchangeable floor/roof panel provides access to the means to adjust the adjustable height of the adjustable foot module.

7. The construction set of claim 6, further comprising a single hand tool, the single hand tool comprises:
a hex head socket;
a drive that holds the hex head socket; and
a ratchet handle that is swivel-attached to the drive.

8. The construction set of claim 1, further comprising:
a support post having a first and second end, a registration pin extending from the first end, a plurality of female lock connectors formed in the support post between the first end and second end, and a notch formed on the second end.

9. The construction set of claim 8, wherein the interchangeable floor/roof panels and the wall panels are "sceniced" to mimic build material.

10. A construction set for a relocatable habitat unit for use in simulating an environment for military combat training, the construction set comprising:
a plurality of interchangeable floor/roof panels having
a periphery defined by a left side edge, a right side edge, a top edge, and a bottom edge,
a plurality of rails formed on a bottom surface of each interchangeable floor/roof panel adjacent the periphery,
at least one adjustable foot module receiver formed in the bottom surface of each interchangeable floor/roof panel,
at least one access hole located on the top of each interchangeable floor/roof panel and positioned collinear with the adjustable foot module receiver, and
a plurality of male lock connectors disposed along the left side edge and the right side edge of each interchangeable floor/roof panel wherein the left side edge and right side edge of each interchangeable floor/roof panel include an equal number of female connectors, disposed in opposing sequences and located on the periphery thereof such that when the left side edge of an interchangeable floor/roof panel abuts the right side edge of another panel each male connector abuts a female connector, and wherein the top edge of each interchangeable floor/roof panel has at least one male or female connector and the bottom edge has at least one male or female connector;
a plurality of wall panels having
a periphery defined by a left side edge, a right side edge, a top edge, and a bottom edge,
a plurality of ledges located near, and parallel to, the bottom edge and top edge of the wall panels, and
a plurality of male lock connectors disposed along the left side edge and the right side edge of each wall panel wherein the left side edge and right side edge of each wall panel include an equal number of female connectors, disposed in opposing sequences and located on the periphery thereof such that when the left side edge of a wall panel abuts the right side edge of another panel each male connector abuts a female connector, and wherein the top edge of each wall panel has at least one male or female connector and the bottom edge has at least one male or female connector;
a plurality of corner posts having
an elongated member with an approximately square cross-section,
a plurality of flanges orthogonally disposed on adjacent sides of the elongated member, and
a plurality of female lock connectors disposed along the length of the elongated member; and
a plurality of horizontal ceiling beams having tabs formed on the interior of the ceiling beam configured to support an edge of the interchangeable floor/roof panels, and a means to lock the horizontal ceiling beams, and wherein the plurality of horizontal ceiling beams are secured between corner post flanges; and
a plurality of corner brackets having a first vertical plate formed with a plurality of holes orthogonally arranged and fixedly attached to a second vertical plate formed with a plurality of holes, and a horizontal top plate arranged perpendicular and fixedly attached to the first vertical plate and second vertical plate and configured to attach to at least one ceiling beam to support a floor panel.

11. The construction set of claim 10, wherein the interchangeable floor/roof panel further comprises:
a frame;
a panel formed within the frame, wherein at least one male and one female lock connecter is formed within the frame;
an access port formed into the panel to access and actuate the at least one male and one female lock connecter located within the frame; and
wherein the frame and the panel are "sceniced" to mimic build material.

12. The construction set of claim 11, wherein the wall panel comprises:
a frame;
a panel formed within the frame, wherein at least one male and one female lock connecter is formed within the frame;
an access port formed into the panel to access and actuate the at least one male and one female lock connecter located within the frame; and
wherein the frame and the panel are "sceniced" to mimic build material.

13. The construction set of claim 12, wherein the interchangeable floor/roof panel is used as a floor panel.

14. The construction set of claim 13, wherein the interchangeable floor/roof panel is used as a roof panel.

15. The construction set of claim 14, further comprising at least one adjustable foot module having an adjustable height and a means to adjust the adjustable height, the at least one adjustable foot module is received by the at least one adjustable foot module receiver and wherein the at least one access hole of the interchangeable floor/roof panel provides access to the means to adjust the adjustable height of the adjustable foot module.

16. The construction set of claim 15, further comprising a single hand tool, the single hand tool comprises:

a hex head socket;

a drive that holds the hex head socket; and a ratchet handle that is swivel-attached to the drive.

17. The construction set of claim 10, further comprising:

a support post having a first and second end, a registration pin extending from the first end, a plurality of female lock connectors formed in the support post between the first end and second end, and a notch formed on the second end.

18. The construction set of claim 17, wherein a first sub-set of the plurality of interchangeable floor/roof panels and wall panels are combined with a plurality of corner posts, ceiling beams, and corner brackets to form a first story of a relocatable habitat unit, and a second sub-set of the plurality of interchangeable floor/roof panels and wall panels are combined with the ceiling beams, and the corner brackets to form a second story of the relocatable habitat unit.

* * * * *